US007650827B1

(12) United States Patent
Spooner, Jr.

(10) Patent No.: US 7,650,827 B1
(45) Date of Patent: Jan. 26, 2010

(54) ROCKET LOADING AND UNLOADING TOOL

(75) Inventor: George E. Spooner, Jr., Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 62 days.

(21) Appl. No.: 10/807,583

(22) Filed: Mar. 18, 2004

(51) Int. Cl.
*F41A 9/00* (2006.01)

(52) U.S. Cl. ..... 89/47; 89/1.1; 89/45

(58) Field of Classification Search ..... 89/1.1, 89/47, 45

See application file for complete search history.

(56) References Cited

U.S. PATENT DOCUMENTS

| | | | | |
|---|---|---|---|---|
| 6,612 A | | 7/1849 | Chambers | |
| 311,974 A | | 2/1885 | Gatling | |
| 932,094 A | | 8/1909 | Becker | |
| 1,326,789 A | | 12/1919 | Schneider | |
| 3,106,033 A | * | 10/1963 | Brewer | 42/69.02 |
| 3,314,332 A | * | 4/1967 | Wallin | 89/45 |
| 3,670,624 A | | 6/1972 | Hayes et al. | 89/47 |
| 4,069,607 A | * | 1/1978 | Jurek | 42/25 |
| 4,547,988 A | * | 10/1985 | Nilsson | 42/16 |
| 5,675,114 A | | 10/1997 | Thebault et al. | 89/45 |
| 6,082,233 A | * | 7/2000 | Han | 81/453 |
| 6,966,210 B2 | * | 11/2005 | Klann | 72/318 |

* cited by examiner

*Primary Examiner*—Michelle Clement
(74) *Attorney, Agent, or Firm*—Fredric J. Zimmerman

(57) ABSTRACT

A tool conforms at one end to an annular nozzle end of a rocket and conforms peripherally to a tube of a launcher for the rocket so that the tool may be inserted into the tube to urge the rocket precisely into a loaded position without slipping from the nozzle and damaging elements inside the nozzle. The tool is configured to receive a blast paddle of the launcher when the paddle is pivoted across the tube to engage a detent and an igniter contact with the rocket in the loaded position. The tool is configured to urge the rocket from the loaded position for unloading from the tube and is constructed of static dissipative material.

8 Claims, 3 Drawing Sheets

ROCKET LOADING AND UNLOADING TOOL

STATEMENT OF GOVERNMENT INTEREST

The invention described herein may be manufactured and used by or for the Government of the United States of America for government purposes without the payment of any royalties therefor.

BACKGROUND OF THE INVENTION (1) Field of the Invention

The present invention relates to ordnance and, more particularly, to rammers and to devices for transferring a rocket to a launcher.

(2) Description of the Related Art

A representative operating environment for the both the prior art and the present invention is shown in FIGS. 1-5 in which various elements are foreshortened and fragmentarily represented for illustrative convenience. FIGS. 2-6 show a rocket loading and unloading tool which incorporates the principles of the present invention and is indicated generally by the numeral 10. The tool, which will subsequently be described in detail, includes a head 11 and a handle 12. The operating environment includes a rocket 15 and a launcher 16 adapted to the rocket, the rocket being depicted within an interiorly cylindrical launching tube 17 of the launcher.

Rocket 15 has a nose end 20 and an aft end 21 and resembles a type of military rocket which has a nominal diameter of 2.75 inch (about 70 mm) diameter. Such a rocket typically has, at its aft end, features such as folding fins which are not involved in the present invention and, accordingly, are omitted from the present application.

Such a rocket corresponding to rocket 15 is loosely and slidably fitted to a tube, which corresponds to tube 17, for loading and discharging through an open forward end 22 of the tube. When loaded, the rocket extends substantially the length of the tube toward a generally open aft end 23 thereof.

Tube end 23 is associated with subsequently described devices for retaining the loaded rocket, igniting it, and subsequently releasing it. As will be described in detail, a rocket loading and unloading tool of the present invention is characterized by its cooperation with such a rocket and such devices. However, it will be apparent to one skilled in the ordnance art that the principles of present invention are applicable to other rocket and launcher structures and cooperative arrangements than those shown and described in the present application.

FIGS. 1, 2, 4, and 5 show a rocket stop 25 fixed within tube end 23 at one side thereof and protruding somewhat rearwardly therefrom. As can be visualized from FIG. 1, when a rocket 15 is loaded into tube 17 from end 22 thereof, stop 25 serves to terminate loading movement of the rocket when rocket end 21 engages the stop, the rocket then being in an initial loading position 26.

Transversely, stop 25 has a wing-like configuration when viewed forwardly of tube 17 from tube end 23 as in FIG. 4. This configuration serves no purpose with the depicted rocket 15, but was required for fins of other rockets to which a launcher, such as launcher 16, was adapted, this stop configuration being accommodated by the structure of tool 10 in a manner subsequently described.

The portion of rocket 15 just forward of its aft end 21 has a number of features associated with tool 10, the depicted features being somewhat schematically represented and best shown in FIGS. 2-4. This portion of the rocket is constructed of steel or other substantial material and serves as a wall 30 defining a converging-diverging nozzle 31 and terminating at end 21 as annular surface 32, which circumscribes the nozzle and is the region of the rocket engaging stop 25 on loading. A thin, disk-like end shield 34 covers surface 32 and the otherwise open end of nozzle 31. This shield is, typically, constructed of aluminum and is 0.005 inch (0.127 mm) thick.

Somewhat forwardly of surface 32, rocket 15 has an electrically conducting igniter contact band 40 extending around the rocket periphery and electrically isolated from wall 30 by an insulating layer 41. An igniter wire 43 extends generally centrally through the nozzle from a propulsion motor igniter, not shown, to a location axially aligned with band 40 and then turns, as shown in FIG. 3, for connection with this band by way of an insulator extending through wall 30. A plug-like weather seal 45, through which wire 43 extends, closes the nozzle forwardly of band 40 and is, typically, constructed of mylar material. Wall 30 has a detent engaging ring 47 which extends about the periphery of this wall at a location forwardly of band 40. Ring 47 may be formed between grooves in the wall associated with fins, not shown, of the rocket.

Referring to FIGS. 1 and 2, it is seen that launcher 16 has a detent and contact mechanism 50 which is disposed at tube end 23 and extends along tube 17 diametrically oppositely of stop 25. This mechanism includes a blast paddle 51, a rocket detent 52, and an igniter contact 53 that cooperate with rocket 15. Since the present invention is only functionally related to mechanism 50, the internal construction thereof is not shown.

It is seen that blast paddle 51 has a pivot 55 disposed somewhat aft of tube 17 and oppositely thereof from stop 25. The paddle moves pivotally between a first position 56 extending parallel to the tube axis, as shown in FIG. 1, and a second position 57 shown in FIGS. 2-4 where the paddle extends transversely across the tube, aft of a loaded rocket, and generally toward stop 25. The length of the paddle is such that, in the second position, the paddle extends across the tube for about half its diameter. As seen in FIG. 3, the paddle is U-shaped with its concave side facing the tube in the second position. Mechanism 50 provides paddle 51 with an "overcenter" action to retain the paddle in its position 56 or 57 when the paddle is moved into each of these positions, the paddle moving into its second position 57 with an audible "snap" for a purpose subsequently described.

Contact 53 and detent 52 are spaced successive distances forwardly of stop 25 such that, axially of tube 17, they align exactly and respectively with contact band 40 and detent ring 47 of a rocket 15 when the rocket is in a loaded position 60. In this position, which is shown in FIG. 2, rocket surface 32 is somewhat forward of stop 25 and paddle 51 is spaced a distance axially of tube 17 from rocket surface 32.

Mechanism 50 is constructed so that, when paddle 51 is in its FIG. 1 or first position 56, contact 53 and detent 52 are retracted from the interior of tube 17 so that a rocket 15 may move axially of tube 17 for loading, firing, or unloading. However, when paddle 51 is in its FIG. 2 or second position 57, contact 53 and detent 52 extend into tube 17. As a result, when a rocket is in loaded position 60 and the paddle is moved to this second position, contact 53 electrically engages band 40 for ignition of the rocket motor and detent 52 engages ring 47 to hold the rocket in the tube. When paddle 51 is subsequently returned to its first position, as by blast through nozzle 31 following motor ignition or by manual movement of the paddle for unloading the rocket, the rocket is freed for movement from tube 17.

It is apparent from the foregoing that, after a rocket 15 is loaded into tube 17 against stop 25 while paddle 51 is in its position 56, it is necessary to move the rocket forwardly into its final loaded position 60. To do this, paddle 51 is moved nearly into its transverse position 57, and the rocket is urged forwardly from the stop until position 60 is attained; whereupon the paddle snaps into its transverse position and detent 52 and contact 53 engage the rocket.

In the prior art, the just described movement of a rocket 15 from engagement with stop 25 precisely into loaded position 60 was carried out by the insertion of any convenient object, such as a dowel rod, though tube end 23 and past paddle 51 into engagement with rocket end surface 32. A similar operation was used in unloading an unfired rocket after moving the paddle into its first position; such an object being used against surface 32 to urge the rocket forwardly until enough of the rocket protruded from tube end 22 for grasping the rocket to withdraw it from the tube.

It is apparent from FIG. 2—when visualized with tool 10 of the present invention omitted—that, when an object such as a dowel rod is placed against surface 32 and forced forwardly against the rocket, the object is likely to slip from this surface and into nozzle 31 to, at least, pierce the thin end shield 34 and, probably, destroy the electrical continuity of igniter wire 43. If only the shield is damaged, it can be replaced, although not in the field. However, if the igniter continuity is broken, the entire rocket motor must be removed and disposed of.

The following four United States patents show representative prior art arrangements for positioning ordnance items in relation to generally tubular structures.

U.S. Pat. No. 311,974 issued 10 Feb. 1885 to Gatling and discloses a hand loading device having a trough which is received in a gun breech and along which a follower is motivated by a lever to correctly position a cartridge. The face of the follower is recessed to prevent it from touching the primer of the cartridge.

U.S. Pat. No. 1,326,789 issued 30 Dec. 1919 to Schneider and discloses a scoop on which rests a powder charge and which has a forward edge peripherally engaging a projectile. The scoop is inserted into a gun bore to carry the charge therein while ramming the projectile.

U.S. Pat. No. 3,120,785 issued 11 Feb. 1964 to Lorimer et al. for a folding ramming device. FIG. 2 shows a cam 31 on one rod-like guide member disposed in a gun breech to position a pair of such members for sliding an ammunition into the gun. FIG. 8 shows the device subsequently rotated and bearing a "ramming bracket" 59 configured to distribute "the ramming action substantially along a diameter of the ammunition to minimize tilting of the ammunition".

U.S. Pat. No. 5,675,114 issued 7 Oct. 1997 to Thebault et al. for a loading/unloading device which carries charges into the chamber of a gun where a lever retains the charges. The device has an transversely arcuate "implement" insertable entirely into the chamber, with the charges and over this lever, for loading and unloading. The implement has a forward end disposed to stop the device by engagement of the periphery of a projectile forward of the charges. The implement may be made of a conductive material "to enable the evacuation of electrostatic charges."

SUMMARY OF THE INVENTION

The present invention is a tool overcoming the above-identified prior art problems with rocket loading and unloading in the above-described operating environment.

More specifically, the tool has a generally cylindrical head which is, preferably, constructed of material which dissipates static electricity. This head conforms peripherally to the interior diameter of a rocket launcher tube with which the tool is to function so that the head is slidably receivable in the tube and guided thereby for free movement axially therein. The head deviates from a complete cylinder by having at least one omitted segment so that the head has a planar surface parallel to its axis, this surface being disposed so that, when the head is received in the launcher tube, this surface is spaced from the tube interior a distance such that the head freely passes obstructions in the tube interior such as the above-described rocket stop 25.

The tool head has a forward face conforming to the aft end of a rocket with which the tool is to function. In particular, this face has an arcuate, forwardly projecting rim conforming radially to the above-described annular surface 32 about nozzle 31 so that, when the tool is urged against the rocket aft end, this tool face engages the rocket at its surface 32 without engagement of the tool with rocket end shield 43.

As a result of the just-described structure, the tool may be inserted into a launching tube to urge a rocket precisely into a loaded position without slipping from the nozzle and damaging elements inside the nozzle.

The tool head has a rectangular slot diametrically opposite the above-identified planar surface. This slot extends radially into the head for a distance somewhat greater than the distance the above-described blast paddle 51 extends across the launcher tube when the paddle is nearly or fully into its second position 57. Also, the width of this slot is somewhat greater than the width of the blast paddle. Additionally, the axial depth of the slot is such that the tool head does not engage the blast paddle when the paddle is disposed across the launcher tube but is not fully into the second position of the paddle corresponding to the above-described fully loaded rocket position 60 where the launcher detent 52 is engaged with rocket ring 47 and launcher igniter contact 53 is engaged with rocket contact band 40.

As a result of the structure described in the previous paragraph, a tool of the present invention is configured to receive the blast paddle of the launcher when the paddle is pivoted across the launcher tube just before and after engagement of the detent and igniter contact with the rocket when the rocket is urged forwardly by the tool from the rocket's initial position against stop 25 into the fully loaded position 60.

Preferably, a tool of the present invention includes a rod fitted to its head and extending axially thereof, the rod being in several sections and having its end opposite the head provided with a T-handle. The head, rod sections, and T-handle may be connected by screw threads for convenient configuration of the tool for loading rockets in close quarters and for storage.

It is an object of the present invention to provide a tool for manipulating ordnance items without damage to the items.

A more specific object is provide a tool for loading or unloading a rocket disposed in a launcher by application of force to an end of the rocket without danger of damaging the rocket.

Another object is to provide such a tool adapted for use with a rocket disposed in a launching tube having elements of predetermined configuration for initial positioning of the rocket.

Still another object is to provide such a tool adapted for use in an operating environment including a rocket disposed in a launching tube associated with elements having predetermined structures and movements thereof for engaging the rocket to retain the rocket in the tube, to provide ignition of the rocket, and to disengage the rocket upon firing or for unloading without firing.

An additional object is to provide such a tool which does not present a static electricity hazard when manipulating electrically ignited ordnance items.

Yet another object is provide such a tool which facilitates the loading and unloading of a rocket in such an operating environment and which may be easily configured for use in a limited space and for storage.

A further object is to provide such a tool which has the foregoing advantages, which is applicable to existing rockets and launchers, which is economical to construct, and which is fully effective.

BRIEF DESCRIPTION OF THE DRAWINGS

These and other objects, advantages, and novel features of the present invention will be apparent from the following detailed description when considered with the accompanying drawings wherein.

DETAILED DESCRIPTION OF THE INVENTION

Referring to FIGS. 2 through 6, it is seen that head 11 of tool 10 may be unitarily constructed from a cylindrical length of any suitable material, a static electricity static dissipative material being preferred so that the tool does not present an electrostatic discharge hazard when loading or unloading a rocket into tube 17. An acetyl material having surface and volume resistivities of $10^9$ to $10^{10}$ ohms/square, as determined by ASTM Method D257, is effective for this purpose.

Figure 3:
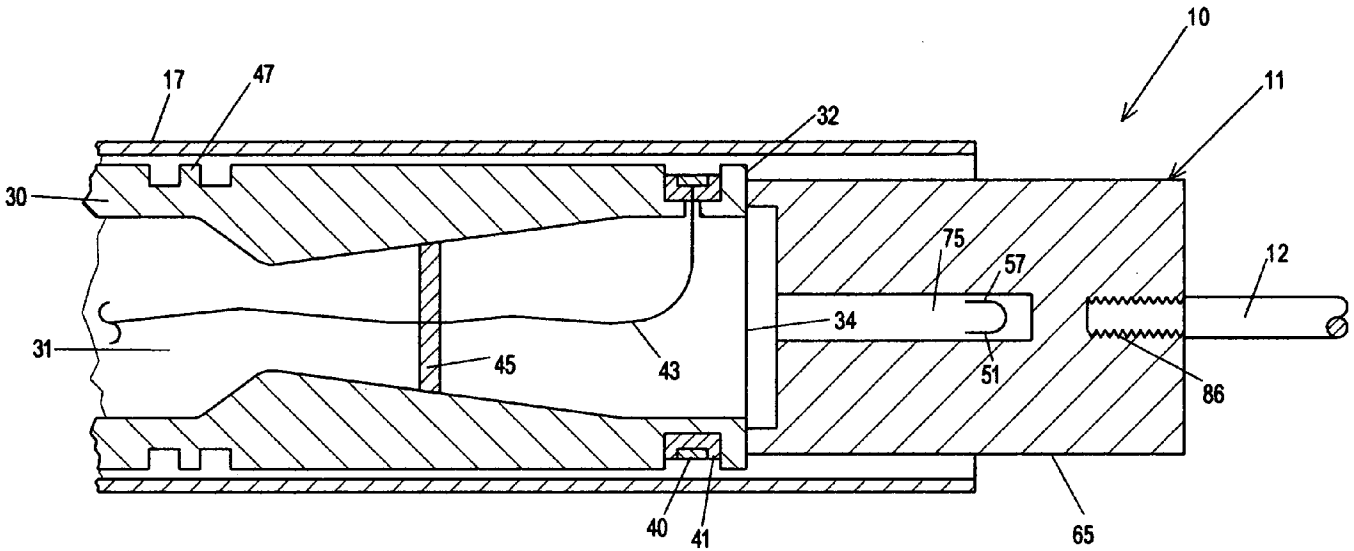
FIG. 3 is a sectional view of the tool, launcher, and rocket taken from the position of line 3-3 of FIG. 2.
Figure 4:
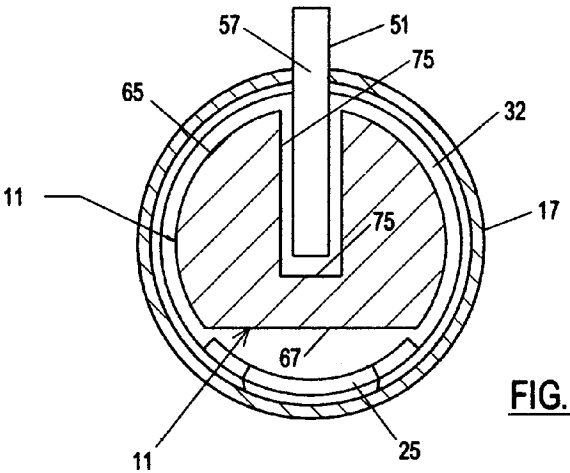
FIG. 4 is a sectional view of the tool, launcher, and rocket taken from the position of line 4-4 of FIG. 2.

As best seen in FIGS. 3 and 4, head 11 has a generally cylindrical peripheral surface 65 somewhat smaller across its greatest dimension than the diameter of the interior of tube 17. Head 11 thus conforms peripherally to the tube interior for slidable movement axially along the tube with the head and tube in generally coaxial relationship. Head 11 has a planar surface 67 extending entirely along one side of the head and parallel to the axis of surface 65 so that generally cylindrical configuration of the head lacks a segment bounded by surface 67. Radially of the head, surface 67 is spaced from the axis of surface 65 a distance such that, when the head is received in tube 17 with surface 67 facing wing-like rocket stop 25, surface 67 clears and does not engage the stop.

Figure 6:
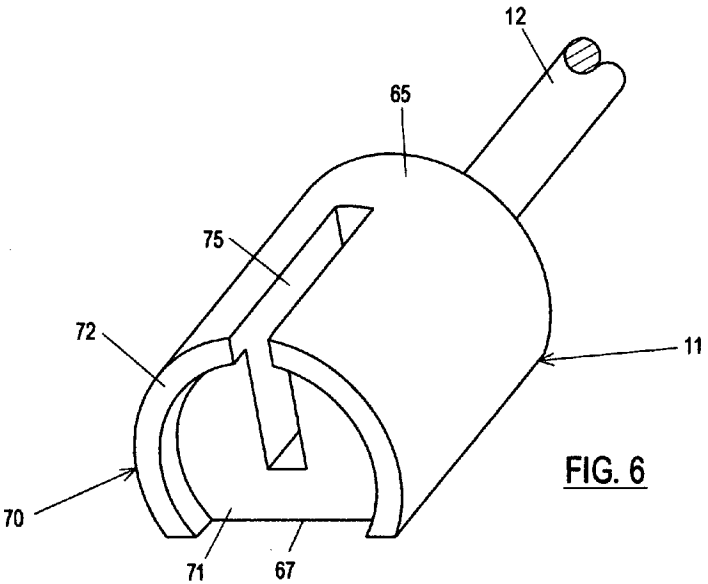
FIG. 6 is a perspective view of the head of the tool.

As best seen from FIG. 6, it is apparent that surface 65 is an arcuate peripheral surface of head 11 and conforms to a segment of a cylinder having a predetermined axis, and surface 67. It is also apparent that surface 67 is a planar peripheral surface of the head and subtends surface 65. It is further apparent that surface 67 extends parallel to this axis and is disposed oppositely thereof from the center of an arc conforming to surface 65.

Head 11 has a forward face 70 conforming to the aft end of the rocket. In particular, this face has a generally central and circular recess 71 so that, peripherally, the face has an arcuate rim 72 with an interior radial dimension substantially equal to the corresponding dimension of annular surface 32 at rocket aft end 21. The surfaces of recess 71 and rim 72, which are disposed toward rocket end 21 when head 11 is engaged therewith, are depicted as planar and normal to the axis of surface 65. As best seen in FIG. 6, rim 72 extends radially inwardly from surface 65, and recess 71 extends inwardly of head 11 in a direction along this axis from the rim. It is evident from FIG. 6, that face 70 is a circular segment bounded by surfaces 65 and 67 and that surfaces 71 and 72 of the face terminate surfaces 65 and 67.

It is evident from the structure described in the preceding paragraph that face 70 is configured to engage the rocket periphery while the rocket end shield 34 is not engaged by the tool.

Figure 1:
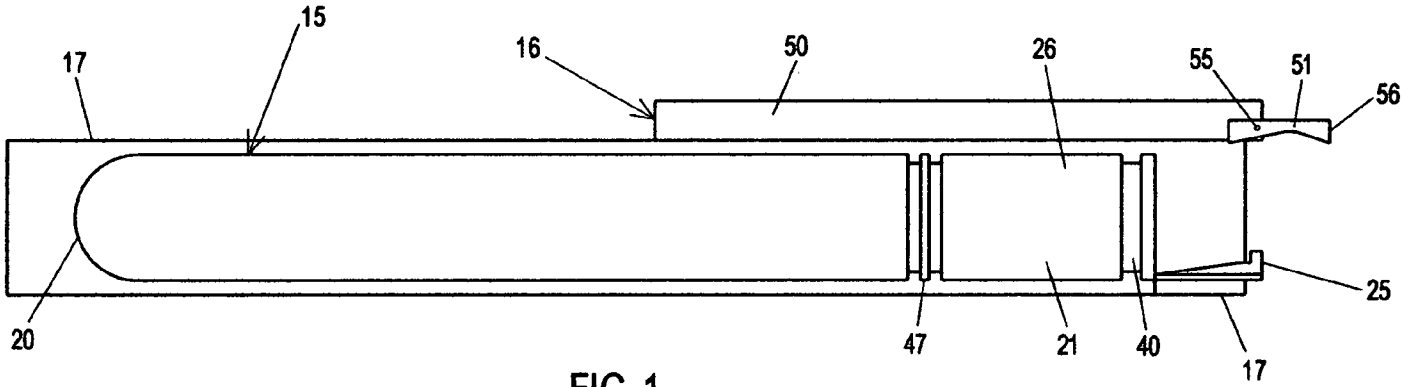
FIG. 1 is a somewhat schematic axial section of a rocket launcher with a rocket received therein, the tube and rocket being a representative operating environment for the present invention, and the launcher including a blast paddle which is depicted in a first position.
Figure 2:
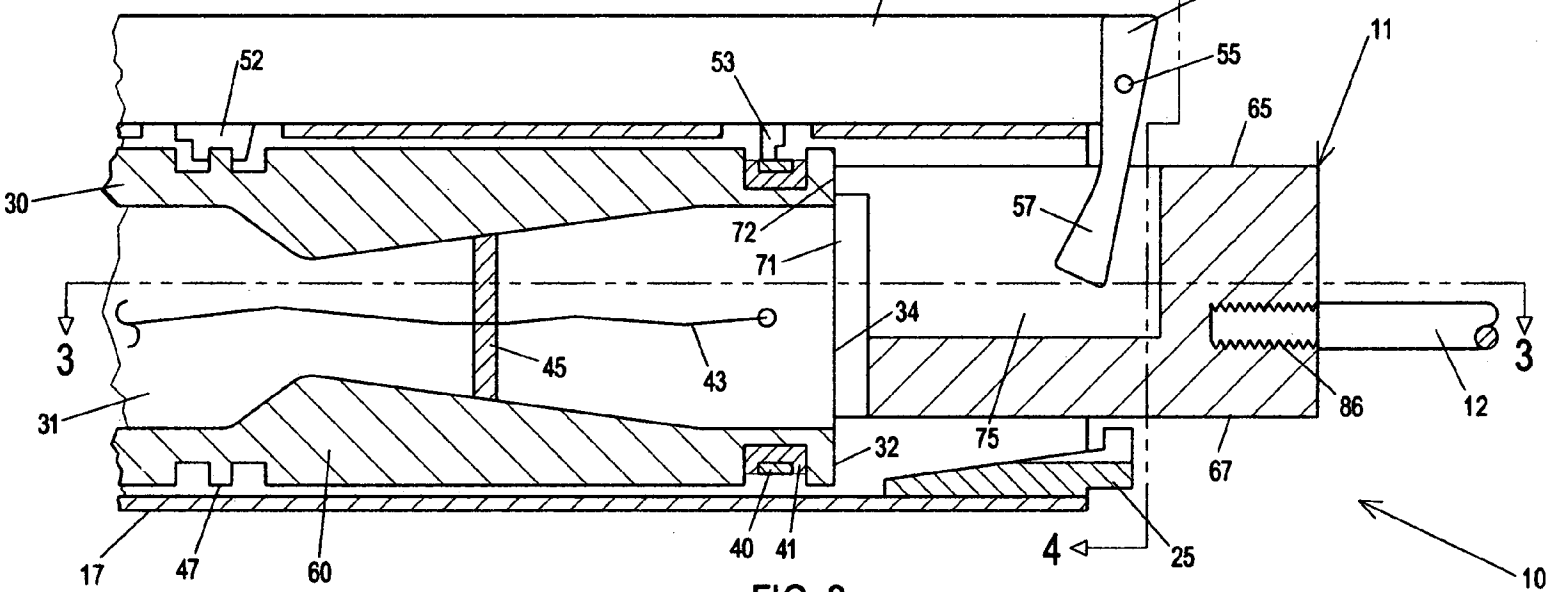
FIG. 2 is an axial section, at a scale enlarged from FIG. 1, of after portions of the rocket and the tube together with a rocket loading and unloading tool of the present invention, the tool having a fragmentarily represented handle and having a head disposed in operating relation to the rocket, to the tube, and to retaining and igniting devices associated with the tube and including the blast paddle, which is depicted in a second position.

Head 11 defines a rectangular recess or slot 75 opposite surface 67 and extending radially into the head for a distance somewhat greater than the distance blast paddle 51 extends across tube 17 when the paddle is in its second position 57. Transversely of the head, the width of slot 75 is somewhat greater than the width of the blast paddle as best seen in FIG. 3. As seen in FIG. 2, slot 75 extends axially into the head a distance somewhat greater than the distance the aftmost portion of the paddle is spaced from the rocket aft end when rim 72 is pressed against rocket surface 32 and the rocket is in its fully loaded position 60 as established by engagement of launcher detent 52 with ring 47 of rocket 15.

From the above, it is evident that, when paddle 51 is in its transverse position 57 and a rocket 15 is in its initial position 26, head 11 is insertable into tube 17, without the head engaging the paddle or stop 25, for urging the rocket into its final position 60 by engagement of head face 70 with rocket annular surface 32 without tool 10 slipping from the annular surface and damaging the rocker.

Figure 5:
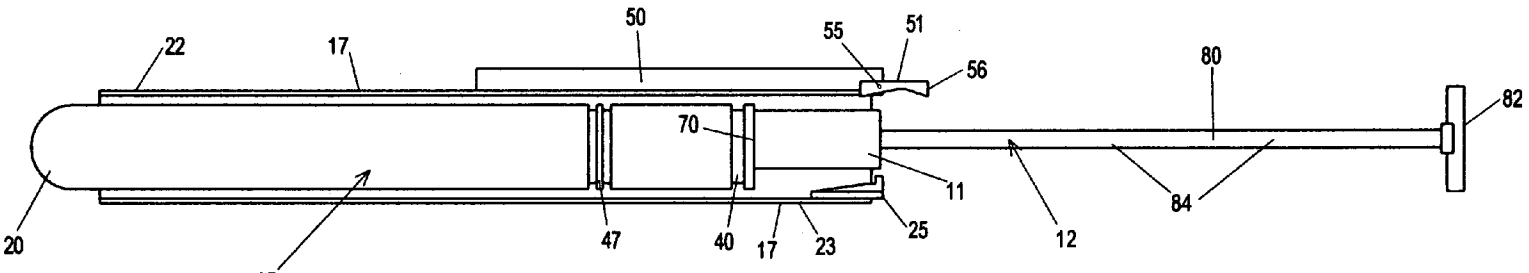
FIG. 5 is a view similar to FIG. 1, but showing the tool configured and being used for unloading a rocket.

As seen in FIGS. 2 and 5, tool handle 12 includes a rod 80 fitted to head 11 and extending axially thereof from an end 81 thereof opposite face 70. The end of the rod opposite the head is, preferably, provided with a detachable T-handle 82. The rod and handle are, typically, constructed of aluminum, and the rod may be provided in several attachable and detachable sections 84 for convenience in storage and use of tool 10 in close quarters. For use with actual rockets of the above-identified type of 2.75 inch nominal diameter, which have a length of about 6 feet (about 1800 mm), rod 75 may have two such sections about 14 inches (350 mm) in length. For convenient and releasable interconnection, head 11, T-handle 82, and each section 84 may be provided with suitable screwthreads as indicated at head end 81 by numeral 86.

It is evident that, as a result of the structure of head 11 which defines the above-described surface 67 and slot 75, tool 10 is configured to pass, without engaging, the obstruction in tube 17 represented by stop 25 and to receive, without engaging, blast paddle 51 when this paddle is pivoted across tube 17 nearly or completely into position 57. It will also be evident that, in loading a rocket 15 into the tube, the structure of head 11, by virtue of surface 65 which conforms to the tube interior, cooperates peripherally with the tube and, by virtue of face 70 which conforms at rim 72 to rocket surface 32, cooperates axially with the rocket aft end 21 so as to prevent damage to the rocket by the tool slipping from the rocket aft end or into nozzle 31.

In such loading of a rocket 15, tool 10 is assembled by connection of its head 11, a convenient number of the rod sections 84, and T-handle 82. A blast paddle 51, which is associated with a launcher tube 17, is placed in first position 56, and then the rocket is inserted fully into the tube from its forward end 22 until rocket surface 32 engages stop 25. The paddle is then moved substantially into its second position 57, and tool head 11 is then inserted forwardly into tube end 21. As this is done, it is apparent that cooperation between the tube interior and the conforming head surface 65 guides the head to move substantially coaxially with the tube and that surface 65 is guided by tube 17 so that the head passes paddle 51 in its transverse position 57 and surface 67 passes stop 25 so that face 70 can engage rocket end 21. As a result, further movement of the tool causes rim 72 to contact rocket surface 32 without engagement of the tool head with either the stop or the blast paddle and without danger of the tool head slipping from its peripheral engagement with surface 32 so as to damage end shield 34 or any element of the rocket within nozzle 31. The tool is then urged forwardly, until the rocket moves into its fully loaded position 60 and the paddle snaps audibly and fully into its second position 57 in which the rocket is retained by detent 47 and engaged for ignition by contact 53. Head 11 is then withdrawn from tube 17 through tube end 23 so that the rocket remains in the loaded position engaged by the detent with end shield 34 and igniter wire 43 undamaged.

Typically and as seen in FIG. 5, both rod sections 84 are utilized in unloading a rocket 15 which has not been fired. Such unloading is carried out by returning blast paddle 51 to its first position 56 to release the rocket from launcher tube 17 and then applying tool head 11 to rocket aft end 21 and urging the rocket forwardly so that enough of the rocket protrudes from tube end 22 for grasping to fully withdraw the rocket from the tube. As this is done, surface 65 is guided by tube 17 so that the head passes paddle 51 in its extended position 56 and surface 67 passes stop 25 so that face 70 can engage rocket end 21.

It is evident that, as in loading a rocket, the previously described conforming relation of the head to the tube interior and to the rocket aft end, prevents damage to the rocket by the tool slipping into nozzle 31. Head 11 is then withdrawn from tube 17 through tube end 23 so that the rocket remains in such a protruding position with end shield 34 and igniter wire 43 undamaged.

It is apparent that, in both loading and unloading a rocket 15 from a tube 17 in accordance with methods of using a tool 10 of the present invention, the rocket is disposed in the tube; the blast paddle is in the extended position—initially on loading and before inserting tool head 11 into the tube on unloading; and the head is inserted into tube end 23 with surface 65 guided by the tube so that surface 67 passes rocket stop and tool face 70 engages rocket annular surface 32 without slipping therefrom and affecting end shield 34 or igniter wire 43. The tool and rocket are then urged toward tube end 22 until the rocket is in a desired position—position 60 on loading and a position protruding from this tube end on unloading.

Although the present invention has been herein shown and described in connection with what is conceived as the preferred embodiment, it is recognized that departures may be made therefrom within the scope of the invention which is not limited to the illustrative details disclosed.

What is claimed is:

1. A tool head, comprising:

an arcuate peripheral surface of the tool head comprising a shape conforming to a segment of a cylinder with said cylinder having a predetermined axis running a length of said cylinder;

a planar peripheral surface subtending the arcuate peripheral surface, said planar peripheral surface extends perpendicular to said arcuate peripheral surface and is disposed oppositely from a center of an arc, which conforms to said arcuate peripheral surface;

a forward axial end face terminating the arcuate peripheral surface and the planar peripheral surface, the forward axial end face includes at least one planar face surface, which extends normal to said predetermined axis; and a rectangular recess being defined by the tool head and axially extending into the tool head in a first direction along said predetermined axis from the forward axial end face, wherein said rectangular recess radially extends openly inward from the arcuate peripheral surface into the tool head in a second direction perpendicular to said predetermined axis, wherein said rectangular recess radially extends completely through said arcuate peripheral surface so that said rectangular recess is oriented opposite said planar peripheral surface, and wherein the arcuate peripheral surface of the tool head extends without interruption from the planar peripheral surface to the rectangular recess.

2. The tool head of claim 1, further comprising a rod structure being disposed at an end of the tool head oppositely of said forward axial end face for attaching a handle to the tool head.

3. The tool head of claim 1, wherein the forward axial end face comprises an arcuate outer planar face surface, which extends radially inward from the arcuate peripheral surface, and a central planar face surface disposed radially within the arcuate outer planar face surface and recessed inwardly of the tool head from the arcuate outer planar face surface in a direction along said predetermined axis, and wherein said central planar face surface is substantially perpendicular to said arcuate outer planar face surface.

4. The tool head of claim 1, further comprising a screwhead releasably attaching a handle to the tool head, said screwhead is disposed at an end of the tool head opposite of said forward axial end face.

5. The tool head of claim 1, wherein the tool head is a single piece of unitary construction.

6. The tool head of claim 1, wherein the tool head is unitarily constructed of a material selected to dissipate static electricity.

7. The tool head of claim 1, wherein the predetermined axis is perpendicular to the planar peripheral surface.

8. The tool head of claim 1, wherein the rectangular recess is a slot shaped configuration, said slot shaped configuration comprises a width oriented transverse to said predetermined axis.

* * * * *